US005216225A

United States Patent [19]

Muto et al.

[11] Patent Number: 5,216,225

[45] Date of Patent: Jun. 1, 1993

[54] FIXING APPARATUS

[75] Inventors: Kiyoshi Muto; Makoto Hasegawa, both of Nagoya, Japan

[73] Assignee: Brother Kogyo Kabushiki Kaisha, Aichi, Japan

[21] Appl. No.: 754,745

[22] Filed: Sep. 4, 1991

[30] Foreign Application Priority Data

Sep. 10, 1990 [JP] Japan ..... 2-240518

[51] Int. Cl.[5] ..... G03G 15/20

[52] U.S. Cl. ..... 219/216; 219/492; 355/282; 355/285

[58] Field of Search ..... 355/208, 282, 285, 289, 355/290; 219/216, 469, 470, 492

[56] References Cited

U.S. PATENT DOCUMENTS

T100,804 7/1981 Ernst ..... 355/285
4,163,892 8/1979 Komatsu et al. ..... 219/216
4,415,800 11/1983 Dodge et al. ..... 219/216 X
4,603,245 7/1986 Yagasaki ..... 219/216
4,627,714 12/1986 Nozaki ..... 219/216

FOREIGN PATENT DOCUMENTS 0011978 1/1983 Japan .
0279380 5/1986 Japan .

*Primary Examiner*—R. L. Moses
*Assistant Examiner*—J. E. Barlow, Jr.
*Attorney, Agent, or Firm*—Kane, Dalsimer, Sullivan, Kurucz, Levy, Eisele and Richard

[57] ABSTRACT

A fixing apparatus is provided with a light heater for heating a heat-fixing roller and a temperature detection element for determining the surface temperature of the fixing roller. A temperature corresponding to a lighting time for the heater is determined and compared with the temperature on the surface of the roller and the result of the comparison is used to turn the heater on and off.

6 Claims, 5 Drawing Sheets

FIG. 2

| | LIGHTING TIME OF HEATER | DETERMINED TEMPERATURE (°C) |
|---|---|---|
| (1) | 0 SEC. ~ 64 SEC. | 180 |
| (2) | 65 SEC. ~ 71 SEC. | 177 |
| (3) | 72 SEC. ~ 77 SEC. | 173 |
| (4) | 78 SEC. ~ 82 SEC. | 170 |
| (5) | 83 SEC. ~ 86 SEC. | 167 |
| (6) | 87 SEC. ~ 89 SEC. | 163 |
| (7) | 90 SEC. ABOVE | 160 |

FIXING APPARATUS

U.S. patent application Ser. No. 07/570,622 filed on Aug. 21, 1990 now U.S. Pat. NO. 5,040,022 in the names of Naohisa KINOSHITA, Hiroyuki KASHIMA, Makoto HASEGAWA, Toshihiro TSUZUKI and Kiyoshi MUTO is expressly incorporated by reference in its entirety herein.

BACKGROUND OF THE INVENTION

This invention relates to a fixing apparatus for fixing a toner image on a support medium such as a sheet of paper by heating the toner image and pressing it thereon.

Heretofore, it is well known to produce a toner image on a suitable support medium through an electrophotography method, electrostatic printing method or magnetic printing method and then to fix the formed toner image by a fixing apparatus for heating and pressing it.

There is disclosed such a fixing apparatus in U.S. Pat. No. 4,603,245, which comprises a heat-fixing roller, a halogen heater for heating the roller, a thermistor for detecting the surface temperature of the roller, and a temperature control means for controlling the surface temperature thereof by turning on or off the halogen heater. The temperature control means controls the halogen heater in such a manner, as shown in FIG. 5, that two different temperatures $t_1$ and $t_2$ are preset, at one of which the heater is turned off and at the other of which the heater is turned on, that when these temperatures are alternately detected, a timer is started, and that the heater is kept ON and OFF until predetermined periods of times a and b preset by the timer are up, respectively. Therefore, the temperature of the fixing roller is controlled so as to be fluctuated within a certain range of two predetermined temperatures $t_1$ and $t_2$. However, generally, the thermistor detects the temperature of the fixing roller with a delay time to cause the difference between a temperature detected by the thermistor and an actual surface temperature of the fixing roller. That is, even if the heater is turned on to raise the temperature of the fixing roller to a temperature higher than the predetermined temperature $t_1$ (for example, 180° C.), the temperature detected by the thermistor is lower than the predetermined temperature and the heater is kept ON. When a temperature detected by the thermistor is raised to a temperature higher than or equal to the predetermined temperature $t_1$, the heater is turned off. However, at this time, the actual temperature of the fixing roller is raised to a temperature (for example, 200° C.) higher than the predetermined temperature $t_1$. Especially, the longer a lighting time of the heater becomes, the larger an increasing ratio, per a unit time, of the temperature of the heater becomes thereby to increase the difference between the detected temperature of the fixing roller and the actual temperature thereof. Likewise, when the heater is turned off, the actual temperature is apt to go down lower than the predetermined temperature $t_2$. As a result, an overshoot of the temperature of the fixing roller occurs as indicated by a dotted line 0 in FIG. 5, and the temperature of the fixing roller cannot be actually controlled within a predetermined range of the two different temperatures. Therefore, a stable fixing of toner on a sheet of paper cannot be performed.

SUMMARY OF THE INVENTION

It is an object of this invention to provide a fixing apparatus which can decrease an overshoot of temperature to maintain constant the temperature of a heat-fixing roller, and can perform a stable fixing of toner on a support medium.

According to the present invention there is provided a fixing apparatus for heat-fixing a toner image developed on a recording medium, which comprises: a heat-fixing roller for heat-fixing the toner image on the recording medium; a heater for heating the heat-fixing roller; a temperature detecting element for detecting a surface temperature of the heat-fixing roller; a counter for counting lighting time of the heater; a temperature determinating means for determining a temperature corresponding to a lighting time counted by the counter; and a control means for comparing a temperature of the heat-fixing roller detected by the temperature detecting element with a temperature determined by the temperature determinating means to turning on or off said heater.

The counter starts its count at the same time when the heater is turned on. The temperature determining means determines a temperature corresponding to a lighting time of the heater. The control means compares the detected temperature with the determined temperature to turn on or off the heater.

Further objects, features and other aspects of this invention will be understood from the following detailed description of the preferred embodiments of this invention with reference to the drawings.

BRIEF DESCRIPTION OF THE DRAWINGS

In the accompanying drawings:

FIG. 2 is a table showing the relationship between a lighting time of a heater and a determined temperature corresponding to the lighting time thereof;

DETAILED DESCRIPTION OF THE INVENTION

Figure 1:
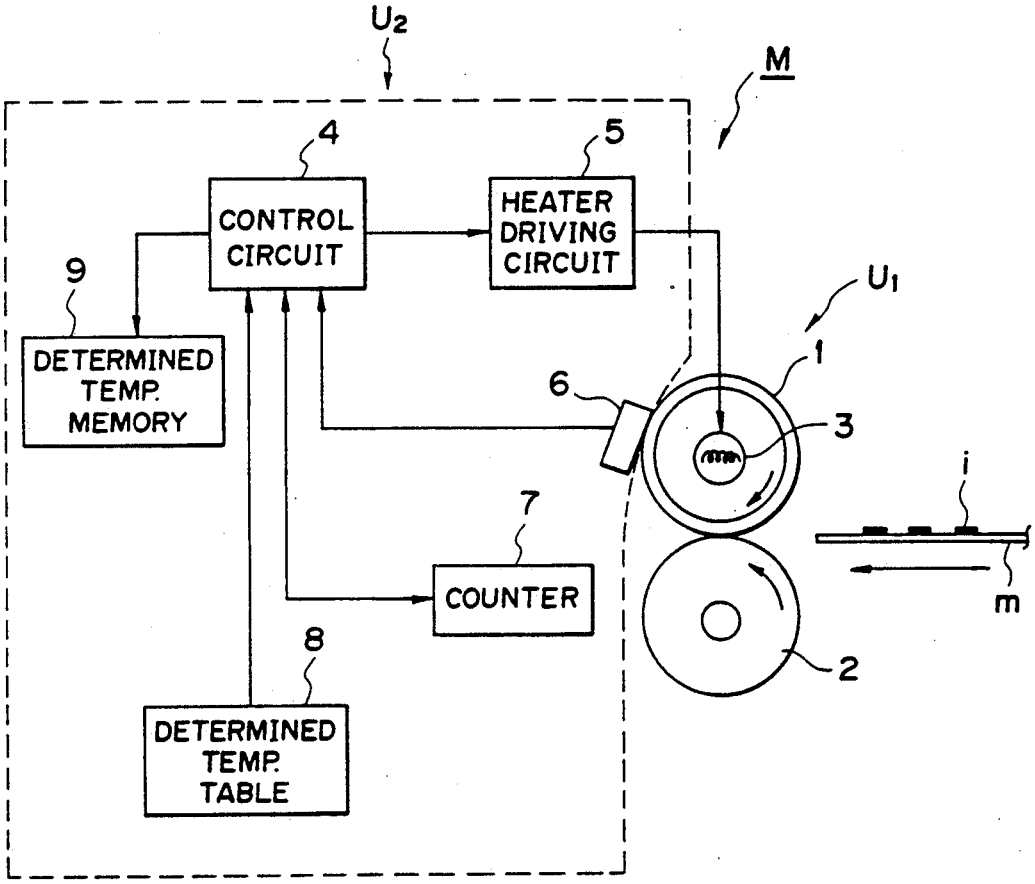
FIG. 1 is a schematic block diagram showing the structure of the present invention.

In FIG. 1, a fixing apparatus M according to this invention comprises a heat-fixing unit $U_1$ for heat-fixing a toner image i on a recording or support medium m and a control unit $U_2$ for controlling the heat-fixing unit $U_1$. The heat-fixing unit $U_1$ has a heat-fixing roller 1 rotated at a constant speed and a pressure roller 2 rotated together with the heat-fixing roller 1 while contacting it. Such a heat-fixing unit $U_1$ is well known and is assembled in a copying machine as disclosed in U.S. Pat. No. 5,040,022 which was filed by the same applicant. The heat-fixing roller 1 has a heater 3 therein such as a halogen lamp for heating the peripheral surface of the heat-fixing roller 1. The recording medium m on which the toner image i is developed by a well known developing device (not shown) is fed between the two rollers 1 and 2 to be heated and pressed thereby.

The control unit $U_2$ comprises a control circuit 4 for controlling the surface temperature of the heat-fixing roller 1, a heater driving circuit 5 for turning on and off the heater 3 in accordance with a heater control signal from the control circuit 4, a thermistor 6 disposed on the outer surface of the heat-fixing roller 1 for detecting the surface temperature of the heat-fixing roller 1, a counter 7 for counting the lighting time of the heater 3, a determined temperature table 8 which is a kind of memory and describes a plurality of predetermined temperatures of the heat-fixing roller 1 in correspondence with a plurality of divided groups of heater lighting time, respectively, and a determined temperature memory 9 for memorizing a predetermined temperature read out of the determined temperature table 8 shown in FIG. 2.

The counter 7 starts counting the lighting time of the heater 3 at the same time when the heater 3 is turned on by the heater driving circuit 5, and stops counting when the temperature of the heat-fixing roller 5 rises until a temperature detected by the thermistor 6 reaches a certain predetermined temperature shown in FIG. 2 and, as a result, the heater 3 is turned off. The control circuit 4 reads the lighting time of the heater 3 counted by the counter 7 when the heater 3 is turned on and reads out of the table 8 a predetermined temperature corresponding to the lighting time of the heater 3 to memorize the read predetermined temperature in the determined temperature memory 9. The determined temperature memorized in the determined temperature memory 9 is compared with the actual temperature of the heat-fixing roller 1 detected by the thermistor 4. The temperature of the heat-fixing roller 3 fluctuates around a desired temperature as shown in FIG. 4.

FIG. 2 is a table showing a plurality of determined temperatures corresponding to a plurality of divided groups of lighting time of the heater 3. The table is previously memorized in a kind of memory. For example, if the lighting time is 75 seconds, the determined temperature is 173° C. The longer the lighting time becomes, the lower the determined temperature becomes. This is because the longer the lighting time becomes, the more an increasing ratio, per a unit time, of the temperature of the heat-fixing roller 1 becomes while a delay time with respect to the detected temperature by the thermistor 4 is constant irrespective of the detected temperature. When the heater 3 is turned on for a long time to increase the increasing ratio, per a unit time, of temperature of the heat-fixing roller 5, the difference between the temperature of the heat-fixing roller 1 detected by the thermistor 6 and the actual temperature of the heat-fixing roller 1 is increased. Therefore, in the table 8, a value subtracted the difference between the two compared temperatures from, for example 180° C. which is the optimum fixing temperature for a toner used for a copying machine is shown as each determined temperature. For example, if the lighting time of the heater 3 is 95 seconds, the determined temperature is 160° C. because the difference between the actual surface temperature of the heat-fixing roller 1 at that time and the temperature thereof detected by the thermistor 6 is approximately 20° C.

Figure 4:
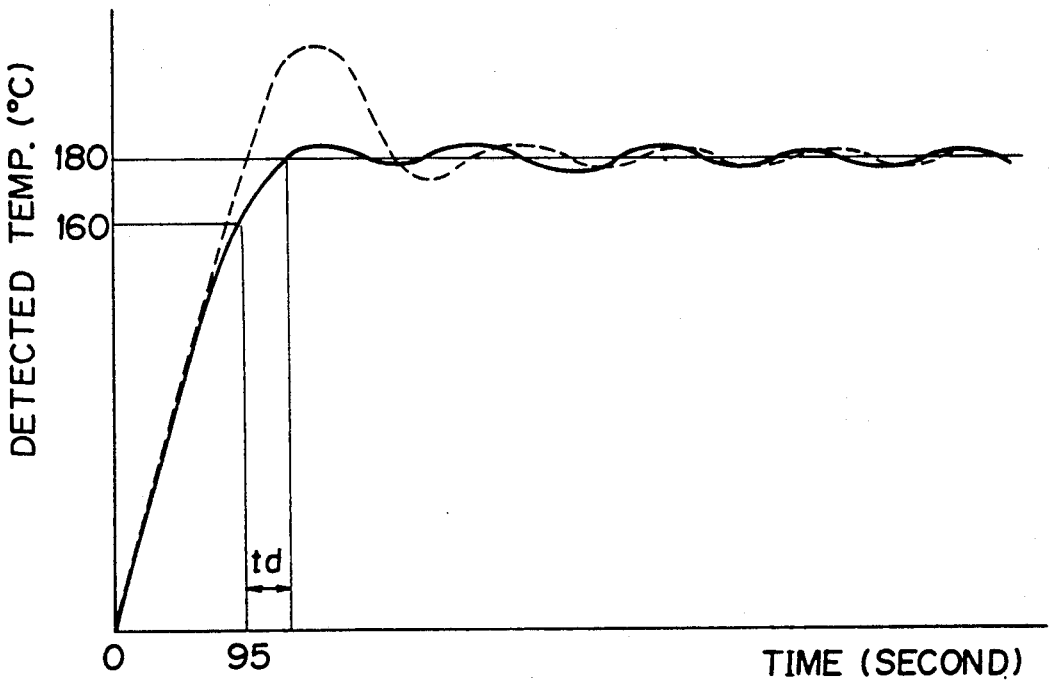
FIG. 4 is a graph showing a change of the surface temperature of a heat-fixing roller.
Figure 5:
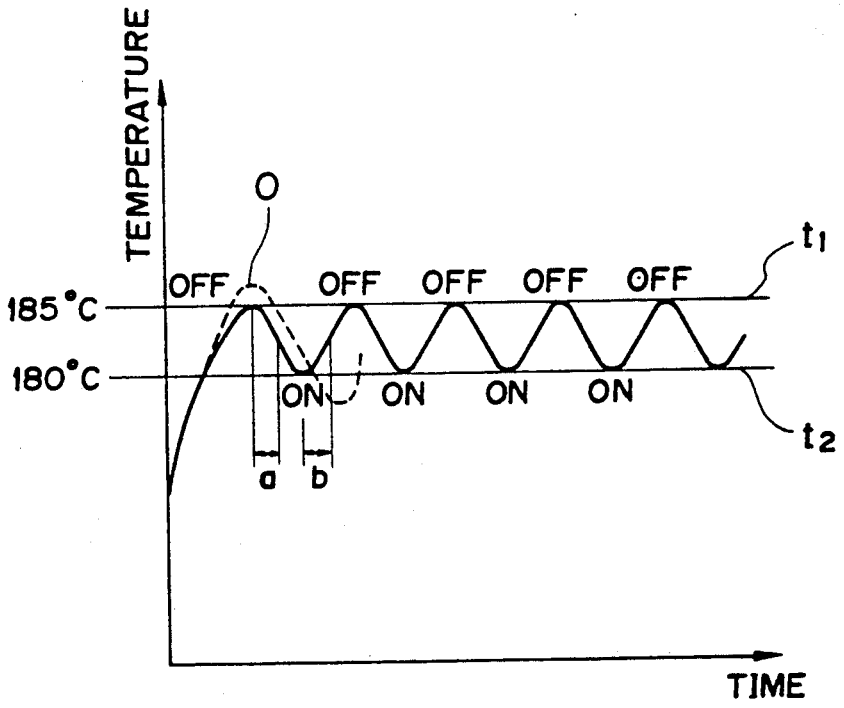
FIG. 5 PRIOR ART
FIG. 5 is a graph showing a change of the surface temperature of a heat-fixing roller according to a conventional temperature control.

FIG. 4 shows a graph showing a change of the surface temperature of the heat-fixing roller 1 after the heater 3 is initially turned on. The axis of abscissa of the graph indicates time (second) after the heater 3 is turned on, while the axis of ordinates thereof indicates temperature detected by the thermistor 6. When the lighting time of the heater 3 is 95 seconds and the surface temperature of the heat-fixing roller 1 is 160° C., the heater 3 is turned off because the determined temperature corresponding to the then lighting time on the table 8 is 160° C. At that time, the actual surface temperature of the heat-fixing roller 1 is the optimum fixing temperature of a toner, that is, approximately 180° C., and the thermistor 6 detects the temperature of 180° C. with a delay time td. Thereafter, the heater 3 is repeatedly turned on and off in a manner described after.

Figure 3:
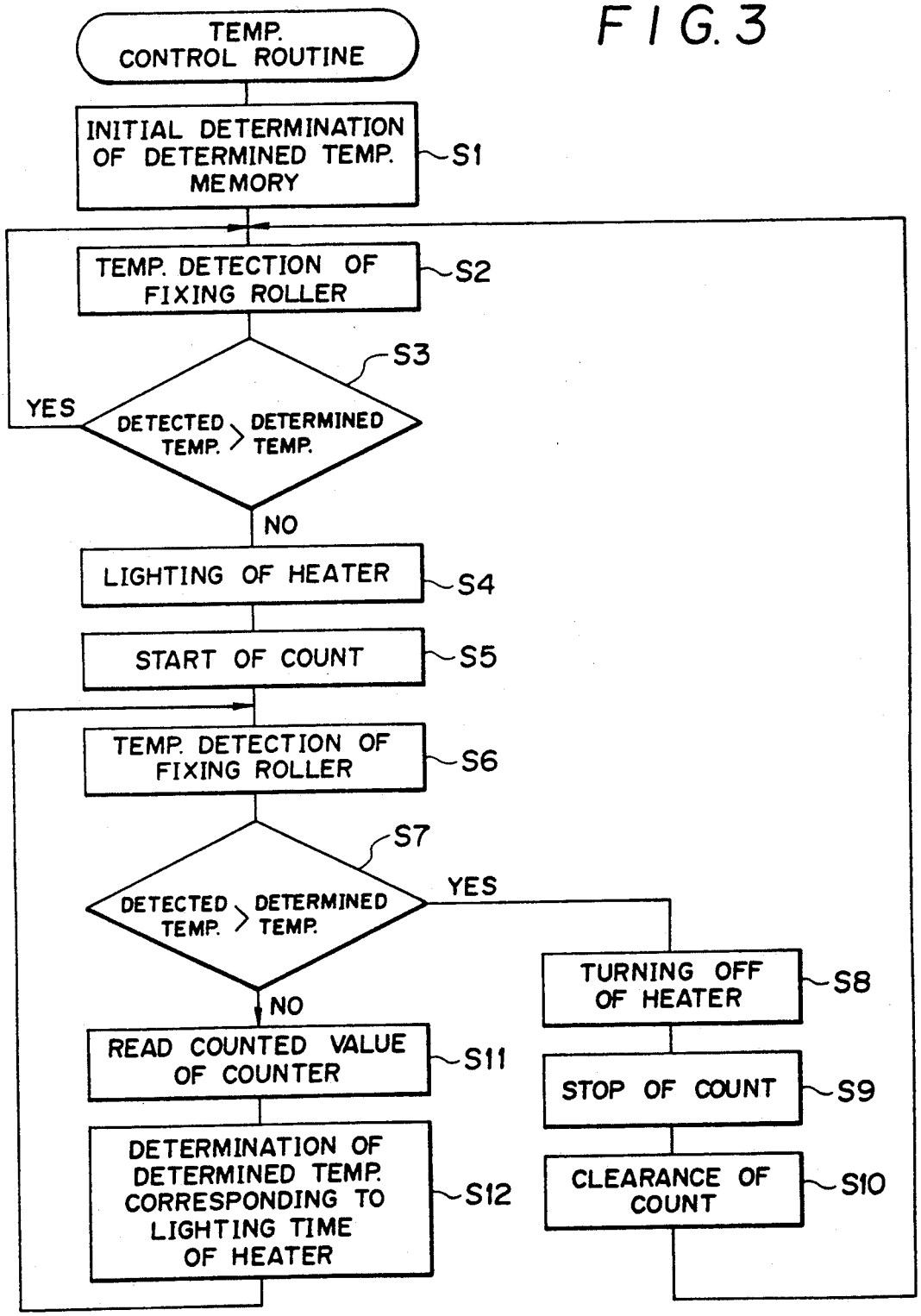
FIG. 3 is a flowchart showing a temperature control routine of the present invention.

A temperature control of the fixing apparatus M will now be explained with reference to FIG. 3.

The flow starts in a state wherein the temperature of the fixing roller 1 is higher than the optimum fixing temperature and the heater 3 is turned off.

First, each determined temperature is initially determined in the determined temperature table 8 in accordance with the optimum fixing temperature of a toner to be used in step 1. That is, if the optimum fixing temperature of the toner to be used is 180° C., a value of 180 is determined in the uppermost column corresponding to a lighting time of 0 to 60 seconds as shown in FIG. 2. Then, each value is determined in each column corresponding to each group of divided heater lighting time in accordance with the optimum determined temperature of 180° C. The temperature of the heat-fixing roller 1 is then detected by the thermistor 6 in step 2. It is determined whether or not the detected temperature is higher than the determined temperature, that is, 180° C. in this case in step S3. If the detected temperature is higher than the determined temperature, that is, the actual temperature of the heat-fixing roller is higher than the optimum temperature, the process returns to step S2. If the detected temperature is not higher than the determined temperature, that is, the actual temperature thereof falls lower than the optimum temperature, the heater 3 is turned on in step S4 and, at the same time, the counter 7 starts its count in step 5. In step 6, the temperature of the heat-fixing roller 1 is detected by the thermistor 6.

It is then determined whether or not the detected temperature is higher than the determined temperature in step S7. If the detected temperature is higher than the determined temperature, the flow goes to step S8 in which the heater 3 is turned off. Then, the counter 7 stops its count in step 9 and the counter 7 is cleared up in step S10. After the heater 3 is turned off, the surface temperature of the heat-fixing roller 1 goes down. Then, the flow returns to step 2 in which the thermistor 6 detects the temperature of the heat-fixing roller 1.

If the detected temperature of the heat-fixing roller 1 is not higher than the determined temperature in step S7, that is, the actual temperature of the heat-fixing roller 1 is lower than the determined temperature, the control circuit 4 reads the lighting time of the heater 3 which is counted by the counter 7 in step 11. In step S12, the determined temperature corresponding to the lighting time read in step 11 is read out of the table 8 shown in FIG. 2 to memorize the value of the temperature in the determined temperature memory 9. For example, if the lighting time is 75 seconds, a value of 173° C. is memorized as a determined temperature in the memory 9. As time goes by, the determined temperature changes to fall down and steps S6, S7, S11 and S12 are repeated until the updated determined temperature becomes higher than the actual detected temperature. When the detected temperature becomes higher than the determined temperature updated in accordance with the lighting time of the heater 3 in step 7, the flow goes to step S8 again to turn off the heater 3. In this manner, the temperature control is performed so as to fluctuate the temperature of the heat-fixing roller 1 around the optimum fixing temperature for a toner to be used as shown in FIG. 4.

According to the present invention, it can compensate for a delay time in detection of the thermistor 6 to determine a predetermined temperature corresponding to the lighting time of the heater 3 for comparing the predetermined temperature with the detected temperature of the heat-fixing roller 1. Therefore, an overshoot in the temperature of the heat-fixing roller 1 is decreased to ensure a stable fixing of a toner on an image recording medium.

The present invention is not limited to the above embodiment and various modifications can be made. For example, the determined temperature table 8 and the determined temperature memory 9 are constructed as a temperature determination means, and, however, there may be used a temperature determination means in which the lighting time of the heater 3 is counted after the determined temperature memory 9 is initially determined, and the value of the memory 9 is decreased as the lighting time of the heater 3 becomes long.

What is claimed is:

1. A fixing apparatus for heat-fixing a toner image developed on a recording medium, said apparatus comprising:

a) a heat-fixing roller for heat-fixing the tone image on the recording medium;

b) a heater for heating said heat-fixing roller;

c) a temperature detecting element for detecting a surface temperature of said heat-fixing roller;

d) a counter for counting a lighting time for said heater;

e) a temperature determining means for determining a temperature corresponding to a lighting time counted by said counter, said temperature determining means comprising a temperature table showing at least three divided groups of lighting times of said heater and at least three determined temperatures corresponding to said groups and a memory for memorizing a determined temperature corresponding to a lighting time shown in the table, the determined temperatures set forth in said table taking into consideration a delay of said temperature detecting element in detection of said surface temperature; and f) a control means for comparing a temperature of said heat-fixing roller detected by said temperature detecting element with a temperature determined by said temperature determining means wherein said control means turns said heater off when a temperature of the heat-fixing roller detected by said temperature detecting element is higher than a determined temperature updated in accordance with a length of a lighting time of said heater and said control means keeps said heater on when the temperature detected by said temperature detecting element is not higher than said determined temperature.

2. A fixing apparatus according to claim 1, wherein said temperature detecting element comprises a thermistor.

3. A fixing apparatus according to claim 1, wherein said control means controls said heater through a heater driving circuit.

4. A fixing apparatus in accordance with claim 1 wherein periods of said lighting times of said groups increase with an increase in said determined temperatures.

5. A fixing apparatus in accordance with claim 4 wherein said periods decrease by approximately 1 second for a 3°–4° C. drop in said determined temperature.

6. A fixing apparatus according to claim 1 wherein said counter starts counting a total lighting time from the time said heater is turned on.

* * * * *